US008757757B2

(12) United States Patent
Takeuchi et al.

(10) Patent No.: US 8,757,757 B2
(45) Date of Patent: Jun. 24, 2014

(54) PRINTING APPARATUS

(75) Inventors: Toshiki Takeuchi, Yokohama (JP); Koichiro Kawaguchi, Yokohama (JP); Kengo Nieda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 390 days.

(21) Appl. No.: 12/964,224

(22) Filed: Dec. 9, 2010

(65) Prior Publication Data

US 2011/0279510 A1 Nov. 17, 2011

(30) Foreign Application Priority Data

May 13, 2010 (JP) ..... 2010-111534

(51) Int. Cl.
*B41J 29/38* (2006.01)

(52) U.S. Cl.
USPC ..... 347/16; 347/8; 347/14

(58) Field of Classification Search
None
See application file for complete search history.

(56) References Cited

U.S. PATENT DOCUMENTS

| | | | | |
|---|---|---|---|---|
| 7,413,271 | B2 * | 8/2008 | Furuya et al. | 347/14 |
| 2002/0001006 | A1 * | 1/2002 | Matsumoto et al. | 347/16 |
| 2007/0064032 | A1 * | 3/2007 | Kawabata | 347/9 |
| 2008/0174626 | A1 * | 7/2008 | Hirao et al. | 347/16 |

FOREIGN PATENT DOCUMENTS

| | | | | |
|---|---|---|---|---|
| JP | 11-249346 A | | 9/1999 | |
| JP | 11249346 | * | 9/1999 | |
| JP | 11249346 A | * | 9/1999 | G03G 15/00 |
| JP | 2001-239715 A | | 9/2001 | |
| JP | 2002-046260 A | | 2/2002 | |
| JP | 2005-170633 A | | 6/2005 | |

* cited by examiner

*Primary Examiner* — Uyen Chau N Le
*Assistant Examiner* — Chad Smith
(74) *Attorney, Agent, or Firm* — Canon USA, Inc., IP Division

(57) ABSTRACT

An apparatus includes an adjusting mechanism configured to change a gap between a print head and a continuous sheet, and the adjusting mechanism controls the gap to be larger than that at the time of printing when a splice of the continuous sheet passes the print head. An unprintable area is set on each of the upstream side and the downstream side of the splice, each having at least a width corresponding to a sum of a length of the plurality of print heads in the direction of sheet conveyance and a distance of movement of the continuous sheet in a period required for the adjusting mechanism to change the gap, and the printing is continued while avoiding the unprintable area.

13 Claims, 10 Drawing Sheets

PRINTING APPARATUS

BACKGROUND OF THE INVENTION

1. Field of the Invention

The present invention relates to a printing apparatus configured to perform printing using a continuous sheet.

2. Description of the Related Art

Rolled continuous sheets are used for a large amount of printing as in the case of a laboratory printing. When manufacturing rolled continuous sheets, in terms of improvement of production yield, there is a case of connecting ends of a plurality of continuous sheets having insufficient lengths with a fixing material such as a splicing tape (hereinafter referred to as "tape") so that a roll having a required length is achieved. This rolled continuous sheet has splices (joined portion) joined with the tape at one or more random positions.

An apparatus disclosed in Japanese Patent Laid-Open No. 2001-239715 is configured to sense the position of the splices by detecting the tape using an optical sensor, set unrecordable areas including the splices, and control not to perform printing in the unrecordable areas. In addition, when the sensed splices pass under a print head, the print head is retracted from a sheet to prevent the print head from coming into contact with the splices.

SUMMARY OF THE INVENTION

In the description about the apparatus disclosed in Japanese Patent Laid-Open No. 2001-239715, there is no specific disclosure about the width to be set as the unrecordable area. The higher the speed of conveyance of the sheet in high-speed printing, the larger the distance of advancement of the sheet becomes in a period required for the print head to move upward and downward. Therefore, contact may be caused by the splice reaching under the print head before the print head is completely raised. When the printing is started before the splice leaves completely from under the print head, since the gap between a nozzle surface and the sheet is larger than the normal condition, the positional displacement of ink dots and, by extension, image failure may occur, or the amount of generated ink mist may increase.

The invention is achieved on the basis of recognition of the above-described problems. The present invention provides a method of preventing printing on splices when printing a plurality of images in sequence on a continuous sheet having at least one splice and ensuring avoidance of contact of the splice of the continuous sheet with a print head.

The present invention provides an apparatus including a sheet feeding unit configured to feed a continuous sheet along a path, a printing unit including a plurality of print heads and being configured to print unit images in sequence on the continuous sheet fed from the sheet feeding unit at a printing position, an adjusting mechanism configured to change a gap between the print head and the continuous sheet, a sensing unit configured to sense a splice of the continuous sheet at a sensing position provided upstream of the printing position in the path; and a control unit, wherein the control unit controls the adjusting mechanism so that the gap is temporality increased when the splice passes the print head, wherein if the sensing unit senses the splice, the control unit controls to set an unprintable area including the splice in a direction of sheet conveyance and continue the printing while avoiding the unprintable area, and wherein the unprintable area is set on each of the upstream side and the downstream side of the splice, each having at least a length corresponding to a sum of a length of the plurality of print heads in the direction and a distance of movement of the continuous sheet in a period required for the adjusting mechanism to change the gap.

According to the embodiment, printing on splices is prevented when printing a plurality of images in sequence on a continuous sheet having a splice and contact of the splice of the continuous sheet with a print head is avoided.

Further features of the present invention will become apparent from the following description of exemplary embodiments with reference to the attached drawings.

DESCRIPTION OF THE EMBODIMENTS

An embodiment of an inkjet printing apparatus will now be described. The printing apparatus in this embodiment is a high-speed line printer using an elongated continuous sheet (an elongated continuous sheet longer than a print unit (referred to as one page or unit image) repeated in the direction of conveyance) and supporting both simplex printing and duplex printing. For example, this high-speed line printer is suitable for a field such as a print laboratory where a large amount of printing is performed. In this specification, even when a plurality of small images, characters, and spaces are mixed in an area of a single print unit (one page), all those included in the area are collectively referred to as a unit image. In other words, the unit image means one print unit (one page) when printing a plurality of pages in sequence on the continuous sheet. It may be referred to simply as an image instead of the unit image. The length of the unit image depends on the image size to be printed. For example, the length of an L-size picture in the direction of conveyance is 135 mm, the length of an A4-size sheet in the direction of conveyance is 297 mm.

The present invention can be widely applied to printing apparatuses using ink and requiring drying such as printers, multifunction peripherals, copying machines, facsimile machines, and manufacturing apparatuses for a variety of devices. The present invention can also be applied to printing apparatuses which are configured to perform printing through a liquid development method by drawing latent images on a sheet applied with photosensitive material using a laser or the like.

Figure 1:
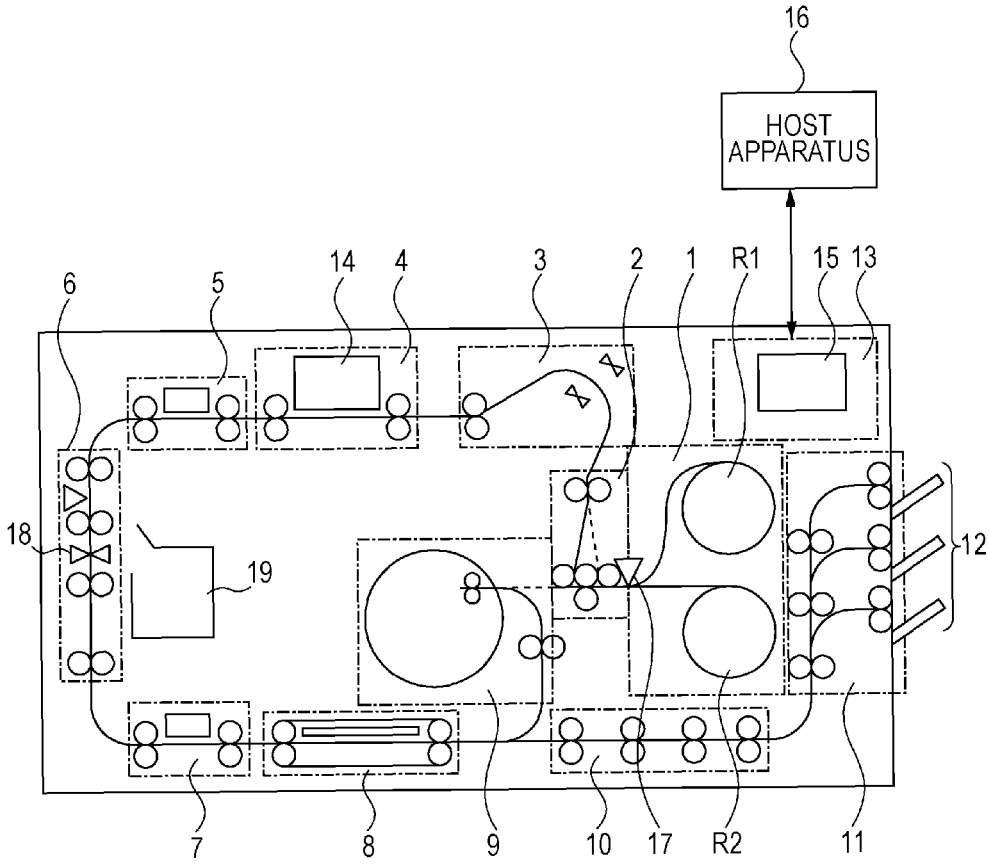
FIG. 1 is a schematic view showing an internal configuration of a printing apparatus.

FIG. 1 is a schematic cross-section showing an internal configuration of the printing apparatus. The printing apparatus in this embodiment is configured to use a roll sheet and be capable of performing duplex printing on a first surface of a sheet and a second surface, which is the back side of the first surface. The printing apparatus generally includes a sheet feeding unit 1, a decurling unit 2, a skew correcting unit 3, a printing unit 4, an inspection unit 5, a cutter unit 6, an information recording unit 7, a drying unit 8, a reverse unit 9, a discharging and conveying unit 10, a sorter unit 11, a discharging portion 12, and a control unit 13 therein. The discharging portion 12 indicates a unit including the sorter unit 11 and being configured to perform a discharging process. The sheet is conveyed by a conveying mechanism including a roller pairs and a belt along a sheet conveying path shown by a solid line in the drawing, and is subjected to processes in the respective units. At a given position in the sheet conveying path, the side closer to the sheet feeding unit 1 is referred to as "upstream" and the opposite side is referred to as "downstream".

The sheet feeding unit 1 is a unit configured to hold and feed a continuous roll sheet. The sheet feeding unit 1 is capable of accommodating two rolls R1 and R2, and is configured to alternatively withdraw and feed a sheet. The number of rolls to be accommodated in the sheet feeding unit 1 is not limited to two, and configurations in which one or three or more rolls are accommodated are also applicable. The sheet is not limited to the roll sheet as long as it is a continuous sheet. For example, a continuous sheet perforated at every unit length, accordion folded at every perforation and stacked, and accommodated in the sheet feeding unit 1 is also applicable.

The continuous sheet used here has splices (joined portions) joined with a tape or glue at one or more random positions. A splice sensor 17 (sensing unit) is provided in the vicinity of an outlet port of the sheet feeding unit 1 to sense the splice of the continuous sheet fed from the sheet feeding unit 1. Detail description is given below.

The decurling unit 2 is a unit configured to alleviate curling (warping) of the sheet fed from the sheet feeding unit 1. The decurling unit 2 alleviates the curling using two pinch rollers per one driving roller and applying a decurling force to the sheet by causing the sheet to pass therethrough while giving a curl to the sheet in the opposite direction.

The skew correcting unit 3 is a unit to correct a skew of the sheet passed through the decurling unit 2 (inclination with respect to a supposed direction of travel). The skew of the sheet is corrected by pressing a sheet edge as a reference side against a guiding member. In the skew correcting unit 3, the conveyed sheet is formed into a loop.

The printing unit 4 is a sheet processing unit configured to form an image by performing printing on the sheet being conveyed from above the sheet using a print head 14. In other words, the printing unit 4 is a processing unit configured to perform a predetermined process on the sheet. The printing unit 4 also includes a plurality of conveying rollers configured to convey the sheet. The print head 14 has an inkjet-type line print head having nozzle rows formed thereon within a range which covers a maximum printing width of a sheet supposed to be used. The print head 14 includes a plurality of print heads arranged in parallel in the direction along the direction of conveyance. In this example, the print head 14 includes seven print heads corresponding to seven colors, namely, C (cyan), M (magenta), Y (yellow), LC (light cyan), LM (light magenta), G (gray), and K (black). The number of colors and the number of print heads are not limited to seven. The inkjet system which can be employed here includes a system using a heat-generating element, a system using a piezoelectric element, a system using an electrostatic element, and a system using MEMS element. Inks in respective colors are supplied from ink tanks to the print head 14 via respective ink tubes.

The inspection unit 5 is a unit configured to scan a test pattern or an image printed on the sheet by the printing unit 4 optically using a scanner, and determine whether or not the image is normally printed by inspecting the state of nozzles of the print heads, the state of conveyance of the sheet, the position of the image, and so on. The scanner includes a CCD image sensor or a CMOS image sensor.

The cutter unit 6 is a unit including a mechanical cutter 18 configured to cut the sheet after having printed into a predetermined length. The cutter unit 6 further includes a cut mark sensor configured to detect optically cut marks recorded on the sheet and a plurality of conveying rollers configured to feed the sheet to a next process. A trash box 19 is provided in the vicinity of the cutter unit 6. The trash box 19 is configured to accommodate small sheet strips cut by the cutter unit 6 and discharged as rubbish. The cutter unit 6 is provided with a dividing mechanism configured to determine whether to discharge the cut sheet to the trash box 19 or to transfer the same to an original conveying path.

The information recording unit 7 is a unit configured to record print information (specific information) such as a serial number or a date of printing on a non-printed area of the cut sheet. The recording is achieved by printing characters or codes through an inkjet system or a thermal transfer system.

The drying unit 8 is a unit configured to heat the sheet printed by the printing unit 4 to dry the ink applied thereto in a short time. In the drying unit 8, hot air is applied to the sheet passing therethrough at least from the lower side to dry a surface having the ink applied thereto. The method of drying is not limited to the method of applying hot air, but may be a method of irradiating the surface of the sheet with electromagnetic wave (UV light, Infrared light, etc.).

The sheet conveying path from the sheet feeding unit 1 to the drying unit 8 as described above is referred to as a first path. The first path has a shape making a U-turn from the printing unit 4 to the drying unit 8, and the cutter unit 6 is positioned at a midpoint of the U-turn shape.

The reverse unit 9 is a unit configured to wind the continuous sheet after having finished the printing on the front surface temporarily and reverse the same upside down when performing the duplex printing. The reverse unit 9 is provided at a midpoint of a path for feeding the sheet having passed through the drying unit 8 to the printing unit 4 again extending from the drying unit 8 via the decurling unit 2 to the printing unit 4 (a loop path) (referred to as a second path). The reverse unit 9 includes a winding rotary member (drum) which rotates for winding up the sheet. The continuous sheet having printed on the front surface thereof but not cut off yet is temporarily wound by the winding rotary member. After having finished the winding, the winding rotary member rotates reversely, and the sheet having wound thereon is fed to the decurling unit 2 in reverse order from the winding procedure, and then fed to the printing unit 4. Since the sheet at this time is reversed upside down, printing on the back side can be performed by the printing unit 4. When the sheet feeding unit 1 is defined as a first sheet feeding unit, the reverse unit 9 can be considered to be a second sheet feeding unit. More specific actions to be taken at the time of the duplex printing will be described later.

The discharging and conveying unit 10 is a unit configured to convey the sheet cut by the cutter unit 6 and dried by the drying unit 8 and deliver the sheet to the sorter unit 11. The discharging and conveying unit 10 is provided in a path (referred to as a third path) different from the second path where the reverse unit 9 is provided. A path switching mechanism having a movable flapper is provided at a branch position of the path for guiding the sheet conveyed through the first path selectively to one of the second path and the third path (referred to as "discharging branch position").

The discharging portion 12 including the sorter unit 11 is provided at the side of the sheet feeding unit 1 and at a terminal end of the third path. The sorter unit 11 is a unit configured to sort the printed sheets into groups as needed. The sorted sheet is discharged to a plurality of trays of the discharging portion 12. In this manner, the third path has a layout passing below the sheet feeding unit 1 and discharging the sheets to the opposite side from the printing unit 4 and the drying unit 8 with respect to the sheet feeding unit 1.

As described above, the units from the sheet feeding unit 1 to the drying unit 8 are provided in sequence in the first path. The downstream side of the drying unit 8 is branched into the second path and the third path, and the second path is provided with the reverse unit 9 at the midpoint thereof, and the downstream side of the reverse unit 9 merges with the first path. The discharging portion 12 is provided at the terminal end of the third path.

The control unit 13 is a unit which is responsible for controlling respective portions of the entire printing apparatus. The control unit 13 includes a controller having a CPU, memories and various kinds of control units, an external interface, and an operation unit 15 which allows users to perform input and output. The action of the printing apparatus is controlled on the basis of commands from a host apparatus 16 such as the controller or a host computer connected to the controller via the external interface.

Figure 2:
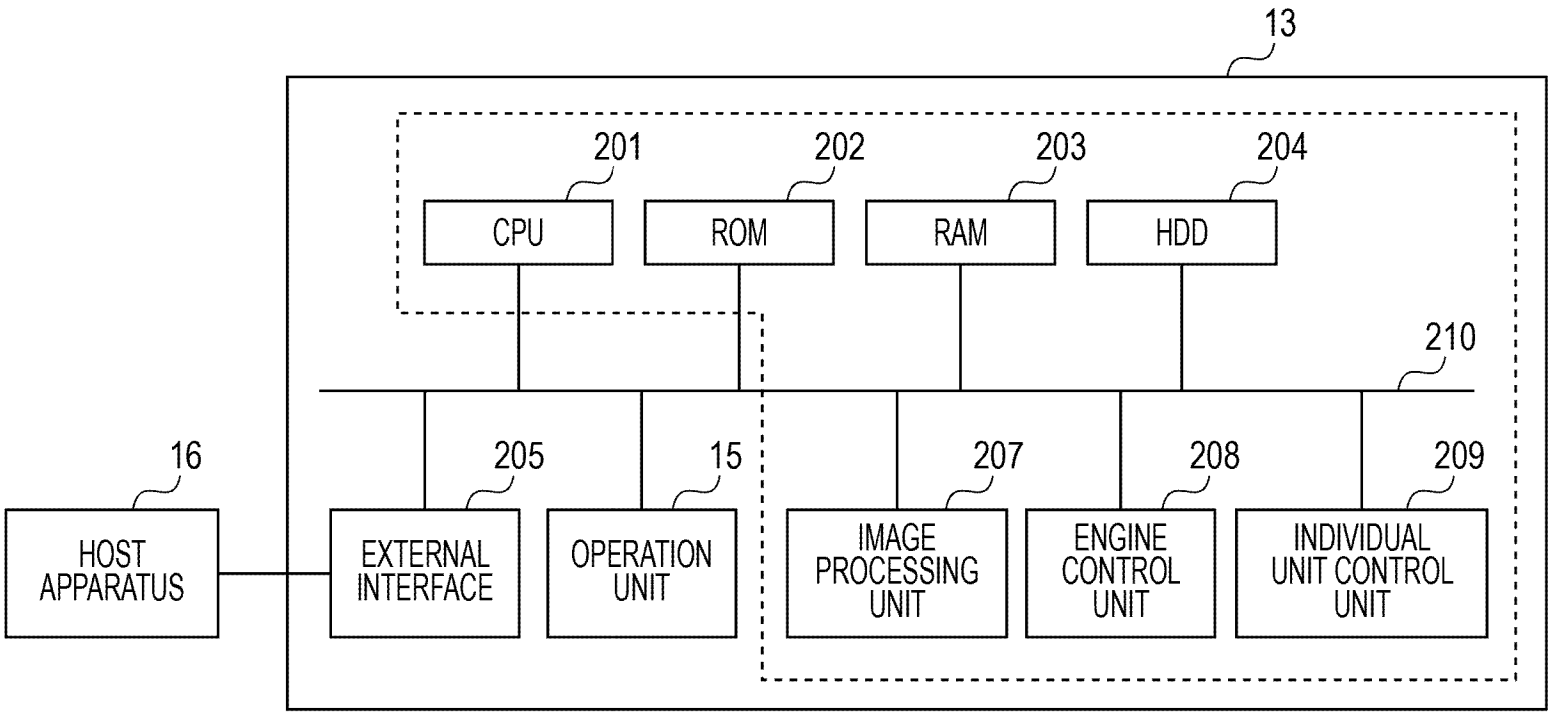
FIG. 2 is a block diagram of a control unit.

FIG. 2 is a block diagram showing a concept of the control unit 13. The controller (a range surrounded by a broken line) included in the control unit 13 is made up of a CPU 201, a ROM 202, a RAM 203, an HDD 204, an image processing unit 207, an engine control unit 208, and an individual unit control unit 209. The CPU 201 (Central Processing Unit) performs integrative control of the actions of the respective units in the printing apparatus. The ROM 202 stores fixed data required for programs executed by the CPU 201 and respective actions of the printing apparatus. The RAM 203 is used as a work area for the CPU 201, is used as a temporary storage area for various received data, and is used for storing various setting data. The HDD 204 (Hard Disk) is capable of storing and retrieving the programs executed by the CPU 201, the print data, and set information required for various actions of the printing apparatus. The operation unit 15 is an I/O interface with respect to users, and includes an input portion such as hard keys or a touch panel, and an output portion such as a display or a voice generator which presents information.

Specific processors are provided for units which require high-speed data processing. The image processing unit 207 performs the image processing of print data handled by the printing apparatus. The image processing unit 207 converts a color space of input image data (for example, YCbCr) into a standard RGB color space (for example, sRGB). The image processing unit 207 also performs various types of image processing such as resolution conversion, image analysis, image correction, and so on for image data as needed. Print data after having subjected to the image processing as described above is stored in the RAM 203 or in the HDD 204. The engine control unit 208 performs drive control of the print head 14 of the printing unit 4 according to the print data on the basis of the control commands received from the CPU 201 or the like. The engine control unit 208 also performs control of conveyance mechanisms in the respective units in the printing apparatus. The individual unit control unit 209 is a sub controller configured to individually control the respective units of the sheet feeding unit 1, the decurling unit 2, the skew correcting unit 3, the inspection unit 5, the cutter unit 6, the information recording unit 7, the drying unit 8, the reverse unit 9, the discharging and conveying unit 10, the sorter unit 11, and the discharging portion 12. The actions of the respective units are controlled by the individual unit control unit 209 on the basis of the commands issued from the CPU 201. An external interface 205 is an interface (I/F) for connecting the controller to the host apparatus 16, and is a local I/F or a network I/F. The components described above are connected using a system bus 210.

The host apparatus 16 is an apparatus which is an image data supply source configured to cause the printing apparatus to perform printing. The host apparatus 16 may be a multipurpose or specific computer, or may be specific image apparatuses such as an image capture having an image reader unit, a digital camera, a photo storage, and so on. If the host apparatus 16 is a computer, OS (operating system), application software used for generating image data, a printer driver for the printing apparatus are installed in a storage device included in the computer. All the processes do not necessarily have to be realized using software and may be realized partly or entirely using hardware.

Subsequently, the basic actions to be performed at the time of printing will be described. As the printing actions in the simplex printing mode are different from those in the duplex printing mode, descriptions will be made for both of them separately.

In the simplex printing mode, the conveying path of the sheet fed from the sheet feeding unit 1, printed thereon, and discharged to the discharging portion 12 is indicated by a thick line. The sheet fed from the sheet feeding unit 1 and subjected to the processes in the decurling unit 2 and the skew correcting unit 3 respectively is printed on the front surface (first surface) in the printing unit 4. Images (unit images) each having a predetermined unit length in the direction of conveyance are printed in sequence on an elongated continuous sheet, so that a plurality of images are formed in line. The printed sheet passes through the inspection unit 5, and is cut off by unit images in the cutter unit 6. The information recording unit 7 records print information on the back surfaces of the cut sheets as needed. The cut sheets are conveyed one by one to the drying unit 8, and are dried thereby. Subsequently, the cut sheets pass through the discharging and conveying unit 10, and are discharged and stacked in sequence in the discharging portion 12 of the sorter unit 11. In contrast, the sheet remaining in the printing unit 4 after the last unit image has cut is fed back to the sheet feeding unit 1, and is wound around the roll R1 or R2. As described later, at the time of the feeding back, the decurling force of the decurling unit 2 is adjusted to be smaller, and the print head 14 is retracted from the sheet. In this manner, in the simplex printing, the sheet passes through the first path and the third path, and is processed therein, but does not pass through the second path.

In contrast, in the duplex printing, a back surface (second surface) print sequence is performed subsequently to the front surface (first surface) print sequence. In the first front surface print sequence, the actions of the respective units from the sheet feeding unit 1 to the inspection unit 5 are the same as those in the simplex printing described above. The cutting action is not performed by the cutter unit 6, and the sheet is conveyed to the drying unit 8 in a state of the continuous sheet. After having dried the ink on the front surface in the drying unit 8, the sheet is guided to a path (second path) on the side of the reverse unit 9 instead of the path (third path) on the side of the discharging and conveying unit 10. In the second path, the sheet is wound on the winding rotary member of the reverse unit 9, which rotates in the normal direction (counterclockwise in the drawing). When the predetermined printing on the front surface by the printing unit 4 is ended, a trailing end of the printed area of the continuous sheet is cut by the cutter unit 6. The continuous sheet on the downstream side (printed side) with respect to the cutting position in the direction of conveyance passes through the drying unit 8 and is wound entirely by the reverse unit 9 until the trailing end of the sheet (cutting position). In contrast, simultaneously with the winding of the sheet by the reverse unit 9, the continuous sheet remaining on the upstream side (the side of the printing unit 4) with respect to the cutting position in the direction of conveyance is fed back to the sheet feeding unit 1 so that a leading end (cutting position) of the sheet does not remain in the decurling unit 2, and is wound by the roll R1 or R2. This feeding back movement (back feed) contributes to avoid collision with a sheet fed again for the back surface print sequence described below. As described later, at the time of the feeding back, the decurling force of the decurling unit 2 is adjusted to be smaller, and the print head 14 is retracted from the sheet.

The printing mode is switched to the back surface print sequence after the front surface print sequence described above. The winding rotary member of the reverse unit 9 rotates in the opposite direction (clockwise in the drawing) from the direction at the time of winding. An end of the wound sheet (the trailing end of the sheet at the time of winding corresponds to the leading end at the time of feeding) is fed to the decurling unit 2 along the path indicated by a broken line in the drawing. In the decurling unit 2, the curl formed by the winding rotary member is straightened. In other words, the decurling unit 2 is a common unit provided between the sheet feeding unit 1 and the printing unit 4 in the first path and between the reverse unit 9 and the printing unit 4 in the second path, and functions to decurl the sheet in the both paths. The sheet reversed upside down is fed to the printing unit 4 via the skew correcting unit 3, and is printed on the back surface thereof. The printed sheet passes through the inspection unit 5, and is cut off by preset unit lengths in the cutter unit 6. Since the cut sheets are printed on both surfaces thereof, and recording in the information recording unit 7 is not performed. The cut sheets are conveyed one by one to the drying unit 8, pass through the discharging and conveying unit 10, and are discharged and stacked in sequence in the discharging portion 12 of the sorter unit 11. In this manner, in the duplex printing, the sheet passes through the first path, the second path, the first path, and the third path in sequence and is processed therein.

Figure 3:
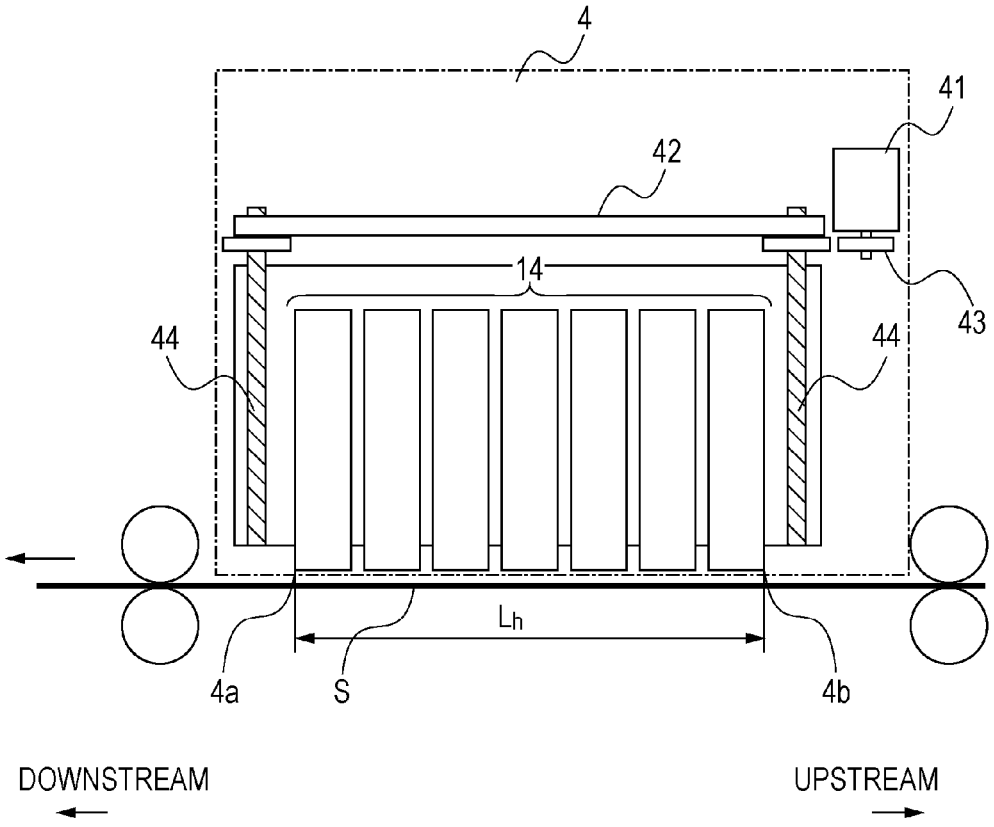
FIG. 3 is a drawing showing a configuration of an adjusting mechanism of a printing unit.

FIG. 3 is a drawing showing a configuration of an adjusting mechanism of a printing unit. The adjusting mechanism is a mechanism configured to change the relative gap between the print head and the continuous sheet. The adjusting mechanism includes a slider mechanism 44 (for example, a ball screw mechanism), and the slider mechanism 44 is operated by a driving mechanism having a motor 41, a belt 42, and a gear train 43. The slider mechanism 44 is capable of moving the plurality of print heads 14 integrally with respect to a continuous sheet S in the direction vertical to the sheet surface. The gap between a printing position 4*a* of the downstream-most print head and a printing position 4*b* of the upstream-most print head among the plurality of print heads 14 is set to be a predetermined distance $L_h$. In this example, the print heads 14 move in the direction of the gap with respect to the continuous sheet S at a certain position. However, a mode in which the continuous sheet S moves in the direction of the gap with respect to the print heads 14 on the contrary may also be employed. Alternatively, a mode in which both the print heads 14 and the continuous sheet S move to change the gap therebetween is also applicable.

Figure 4:
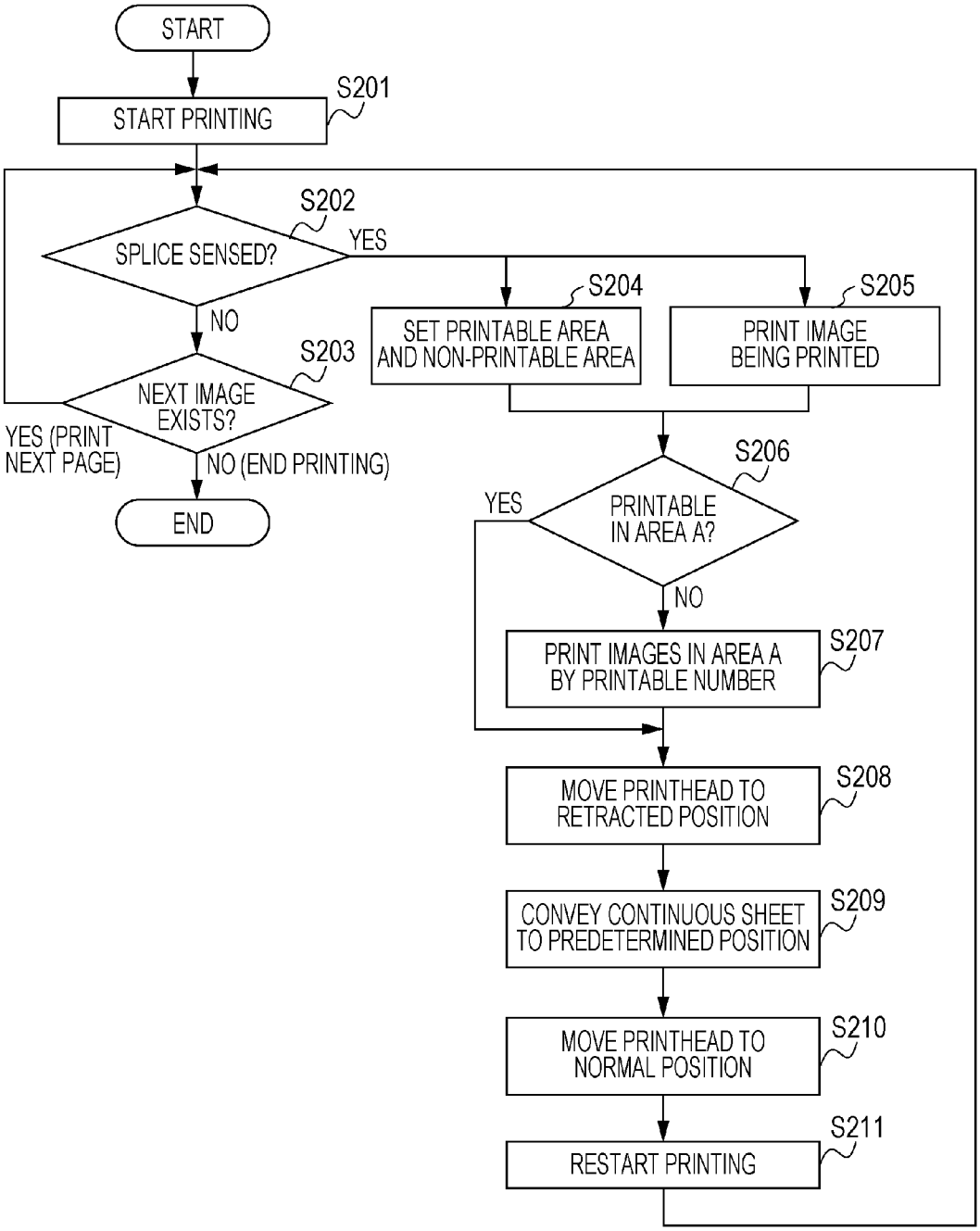
FIG. 4 is a flowchart generally showing a sequence of actions.
Figure 5:
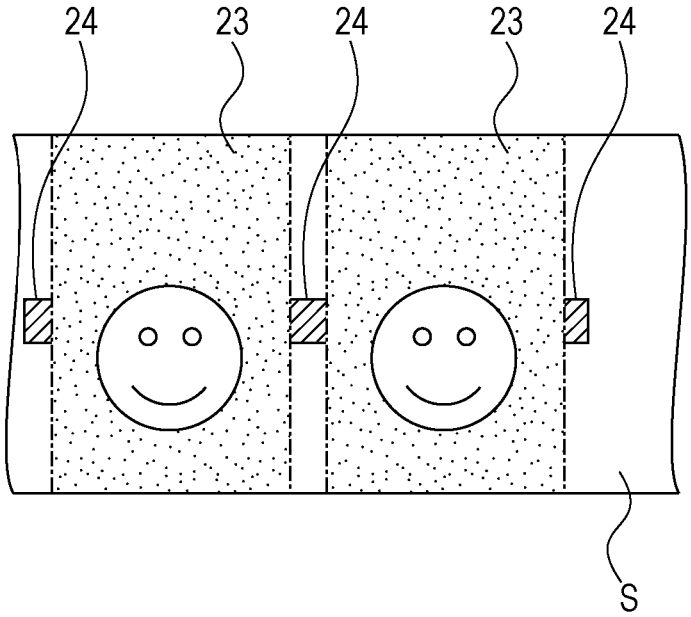
FIG. 5 is a drawing showing a layout of unit images to be printed and margins.

Subsequently, actions to be taken when the splice of the continuous sheet is sensed in the printing apparatus having the configuration as described above will be described in detail. FIG. 4 is a flowchart generally showing a sequence of actions. In Step S201, the printing action is started upon receipt of a command to start the printing process. As shown in FIG. 5, a plurality of images 23 as unit images are printed in line on the continuous sheet S, and cut marks 24 are formed in margins between the adjacent images 23. The cut marks 24 serve as references when cutting both ends of the images 23 in the cutter unit 6.

Figure 6:
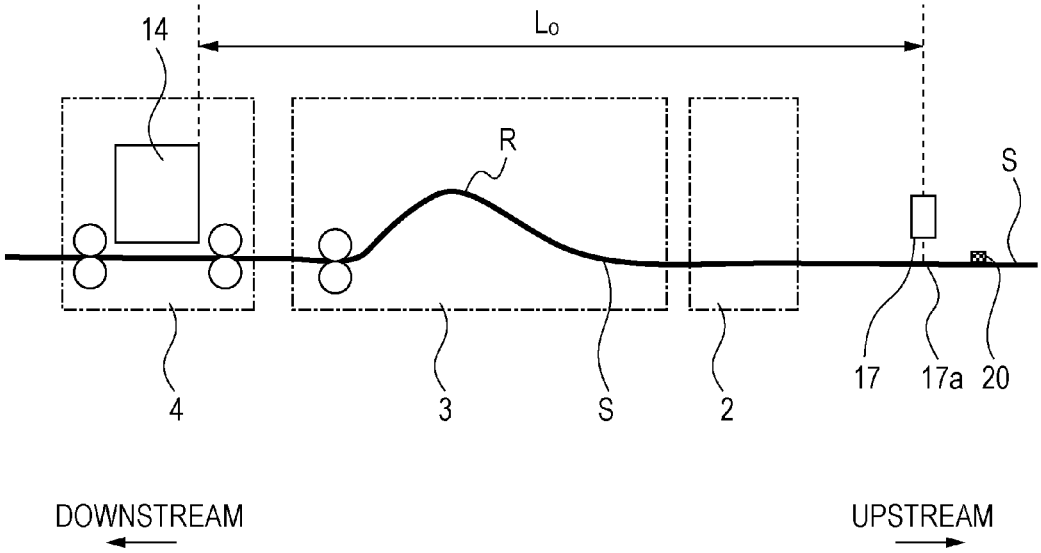
FIG. 6 is a schematic drawing showing a conveying path from a splice sensor to the printing unit.

In Step S202, the splice of the continuous sheet S is sensed by the splice sensor 17. FIG. 6 is a schematic drawing showing the order of arrangement of the units in the conveying path from the splice sensor 17 to the printing unit 4. These units are arranged linearly in the drawing for easy understanding. Positioned on the downstream of a sensing position 17*a* of the splice sensor 17 in the direction of conveyance are the decurling unit 2 and the skew correcting unit 3. The continuous sheet S is formed into a loop R in the skew correcting unit 3, and the length of the continuous sheet S is elongated correspondingly in this section. When a splice 20 of the fed continuous sheet S passes through the sensing position 17*a* (right under the splice sensor 17), a signal level of the splice sensor 17 is changed, and hence the passage of the splice 20 is sensed. The splice sensor 17 is a reflective photo sensor, and is configured to capture the difference between surface reflectivity of the continuous sheet S and the splice 20 (tape), or the level difference at an edge of the tape of the splice 20 from the change in received amount of reflected light. A transmissive photo sensor may be employed as the splice sensor 17. In this case, the splice 20 can be detected by capturing the difference in transmissivity between the sheet S and the splice 20. Alternatively, a direct-contact sensor may be employed as the splice sensor 17 instead of an optical sensor. The direct-contact sensor is capable of detecting the splice 20 by detecting the change in thickness of the splice 20 on the basis of the change in amount of movement of a contact shoe which comes into contact with the sheet S.

If the splice is sensed in Step S202 (Yes), the procedure goes to Step S204 and, if not (No), the procedure goes to Step S203. In Step S203, whether there is a next image to be printed or not is determined. If the result of determination is Yes, the procedure goes back to Step S202, and if not (No), the sequence is ended.

In Step S204, an unprinted area of the continuous sheet S on the upstream side of the printing position is divided to calculate and set a printable area 21 and an unprintable area 22, respectively. Detail description is given below. In parallel with it, in Step S205, printing of a remaining part of an image being printed (the unprinted image portion of the image being printed: length $L_{RE}$) at a timing when the splice 20 is sensed is continued.

Figure 7A:
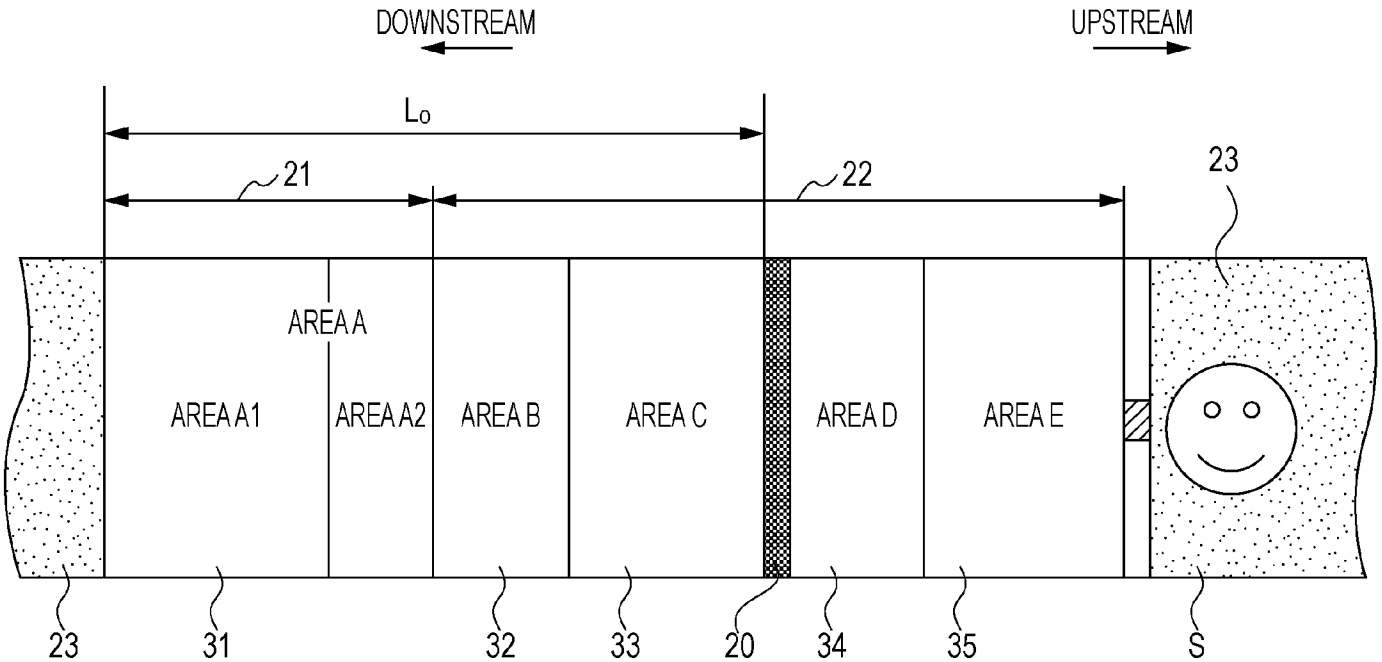
FIGS. 7A and 7B are drawings conceptually showing set areas.
Figure 7B:
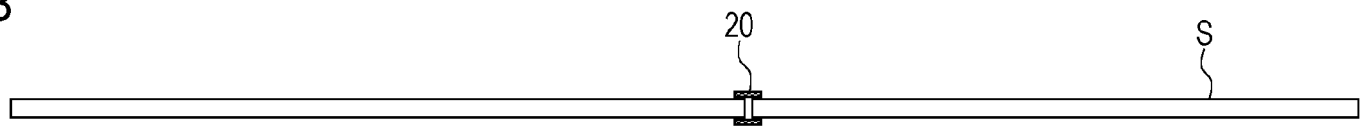

FIGS. 7A and 7B are drawings conceptually showing areas set in Step S204. FIG. 7A is a plan view and FIG. 7B is a cross-sectional view. The entire part is divided into areas A to E and the splice 20, and the splice 20 having a predetermined width is positioned between the area C and the area D.

The area A includes an area A1 and an area A2, which are areas where images can be printed (printable areas 21). The range where the image is to be printed in the printable area 21 varies depending on the timing when the splice 20 is sensed. The area A1 is an area to be printed, and the area A2 is an area not to be printed. In contrast, the area B to area E is an area including the splice 20 at the center where printing is prohibited (unprintable area 22).

Figure 8:
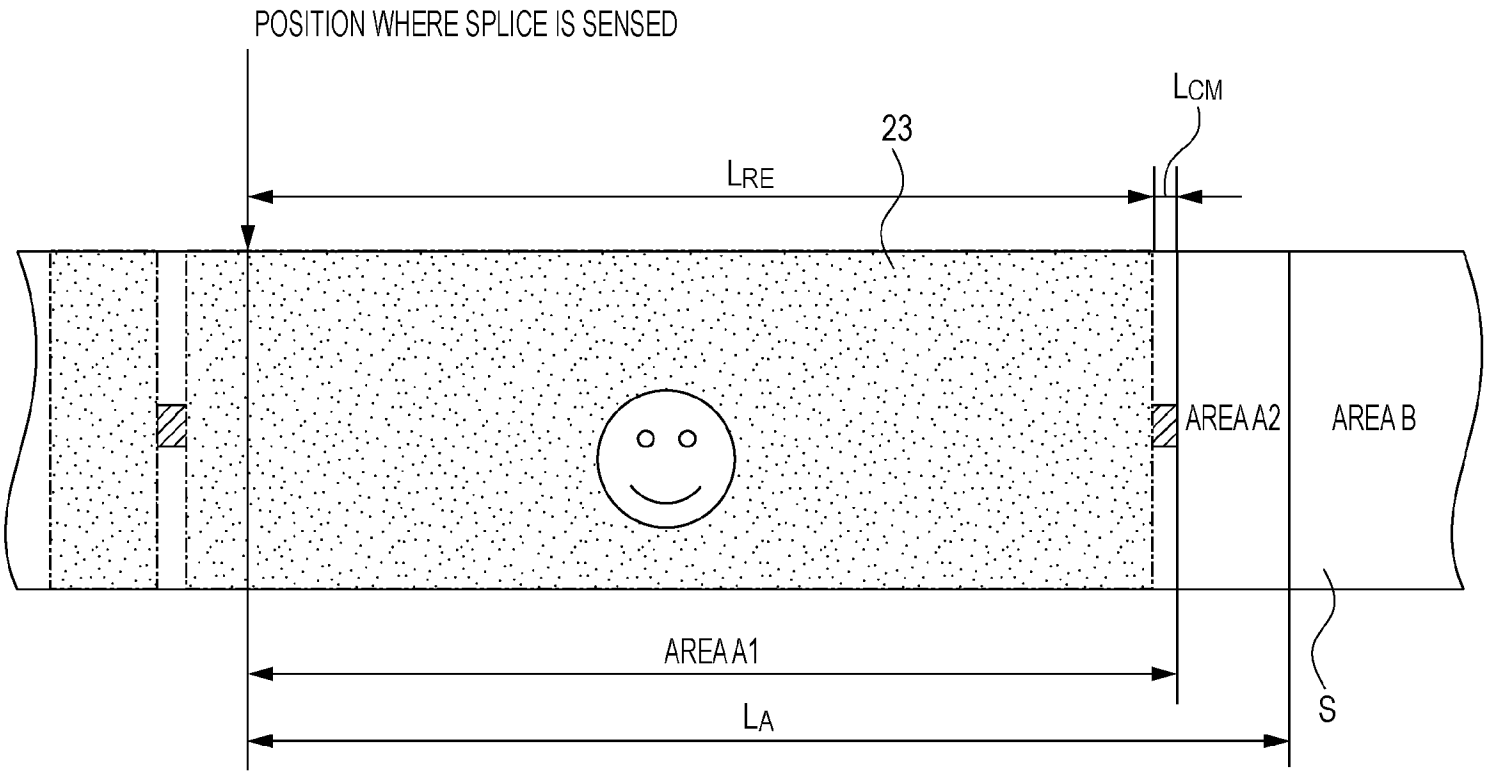
FIG. 8 is a drawing showing an arrangement of a large image (maximum image) in an image area A at the time of repeated printing.

The printable area 21 (area A) will be described. FIG. 8 shows a case where the splice 20 is sensed during printing of the image 23 as a maximum sized unit image that is supposed to be printed by the printing apparatus (the length in the direction of conveyance is $L_{PMAX}$). A length $L_A$ of the area A in the direction of conveyance is set to be longer than the total length of the maximum image length $L_{PMAX}$ and a length $L_{CM}$ of a margin including the cut mark ($L_A > L_{PMAX} + L_{CM}$). Therefore, the printing of the image being printed can be completed irrespective of the timing when the splice 20 is sensed.

If the sheet is discharged in a state in which the image being printed is not completed, the cut sheets stacked on the discharging portion 12 after having printed and cut in sequence include those having defective images mixed in those having normal images. Therefore, the user is obliged to check all the printed results and remove the defective images, which is quite troublesome. In addition, if the defective images are mixed during the duplex printing, the entire printing schedule is changed, and hence the sequence of the cut sheets to be output to the discharging portion 12 may be changed. In a case where the sequence of the images (the sequence of pages) to be printed continuously has a meaning as in the case of a photo album, if the sequence of the images to be printed is changed, the user is obliged to see the printed results and rearrange the same, which is quite troublesome. By employing the sequence in this embodiment, the user is not forced to be bothered by such troubles.

Figure 9:
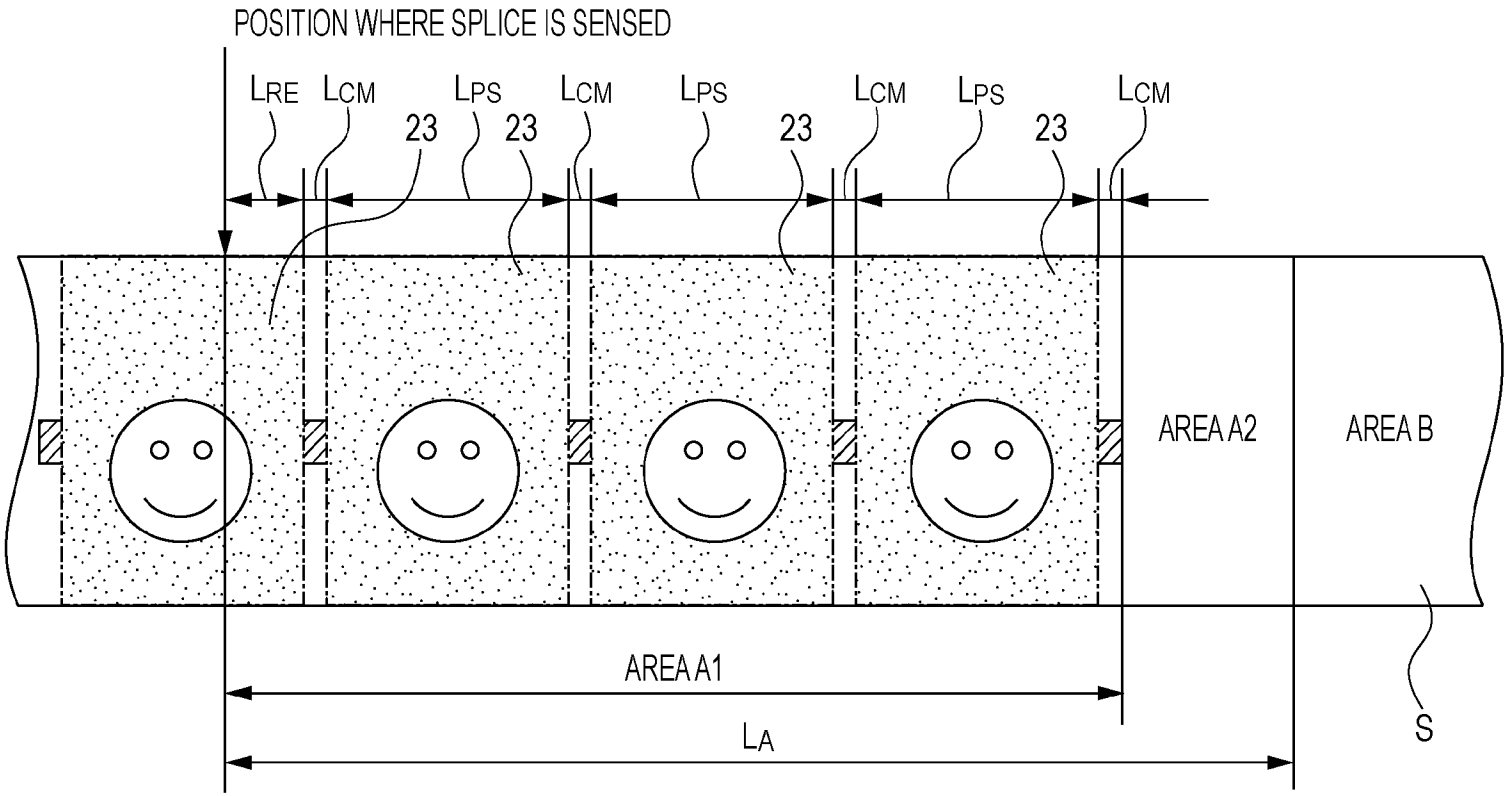
FIG. 9 is a drawing showing an arrangement of small images in the image area A at the time of the repeated printing.

Returning back to FIG. 4, in Step S206, whether or not the subsequent image 23 in the area A can be printed is determined when printing of the image being printed and the cut mark 24 in the margin is performed. For this determination, the number of printable unit images N is calculated using a following expression (Expression 1);

$$N = \mathrm{INT}((L_A - (L_{RE} + L_{CM}))/(L_{PS} + L_{CM}) \quad \text{(Expression 1)},$$

where $L_A$ is a length of the area A, $L_{CM}$ is a length of margin, $L_{PS}$ is a length of a unit image, and $L_{RE}$ is a length of an unprinted image portion of the image being printed. FIG. 9 shows an example of printing the unit images of a relatively small size repeatedly. A plurality of unit images can be printed in remaining areas even after having printed the image being printed and the cut mark 24. The number of printable unit images N is calculated from (Expression 1).

The width of the area A1 and area A2 in the direction of conveyance is set as in (Expression 2) shown below;

$$A1 = (L_{RE} + L_{CM}) + N \times (L_{PS} + L_{CM}) A2 = L_A - A1 \quad \text{(Expression 2)}.$$

For example, the number of printable unit images N is 5 from the expression; (INT((635−(50+5)/(101.6+5)=5.4 . . . ), where $L_A$=635 mm (25 inches), $L_{PS}$=101.6 mm (4 inches), $L_{RE}$=50 mm, and $L_{CM}$=5 mm. Therefore, A1=(50+5×(101.6+5))=583 mm, and A2=(635−583)=52 mm are established.

In the example shown in FIG. 8 described above, the unit image ($L_{PMAX}$) having the maximum size is repeatedly printed, and the result of calculation using (Expression 1) is N=0. A relationship; $(L_A - (L_{RE} + L_{CM})) < L_{PMAX} L_{CM})$ is established. The width of the area A1 and area A2 in the direction of conveyance is set as in (Expression 3) shown below;

$$A1 = L_{RE} + L_{CM}$$

$$A2 = L_A - A1 \quad \text{(Expression 3)}.$$

If the determination in Step S206 is Yes, the procedure goes to Step S207, and if the determination is No, the procedure goes to Step S208. In Step S207, images by a number printable in the area A1 (zero, or one or more) are printed.

Subsequently, the splice 20 passes under the print head 14. The adjusting mechanism is controlled so that the gap is temporarily increased in comparison with the normal state (at the time of printing) when the splice 20 passes, and is returned to the normal state after having passed. In order to do so, in Step S208, the print head 14 is moved from the normal position assumed at the time of printing to a retracted position using the adjusting mechanism described above. As described later, a predetermined period is required from the beginning to the end of the movement, and during this period, the continuous sheet S moves. In subsequent Step S209, the adjusting mechanism waits until the continuous sheet S is conveyed by a gap $L_D$ and the splice 20 completely passes immediately under all the plurality of print heads. In Step S210, the adjusting mechanism moves the print head 14 from the retracted position back to the printing position again. In this case as well, the predetermined period is required from the beginning to the end of the movement, and during this period, the continuous sheet S moves.

In Step S211, printing of the unit image on the continuous sheet in the areas following the splice 20 is restarted. The areas A2 to E which are not printed are cut by the cutter unit 6, and are discharged to the trash box 19 as the defective images.

The unprintable areas 22 will be described further in detail below. As described in FIG. 7, the unprintable area 22 includes the splice 20 at the center, and includes the unprintable area having the area B and the area C on the downstream side of the splice 20 and the unprintable area having the area D and the area E on the upstream side of the splice 20. In other words, the unprintable area 22 includes the areas having a predetermined length on the upstream side and the downstream side of the splice 20. The predetermined length is set to have at least a width corresponding to a sum of the length of the plurality of print heads 14 in the direction of conveyance and the distance of movement of the continuous sheet S in the period required for the adjusting mechanism to change the gap.

Figure 10A:
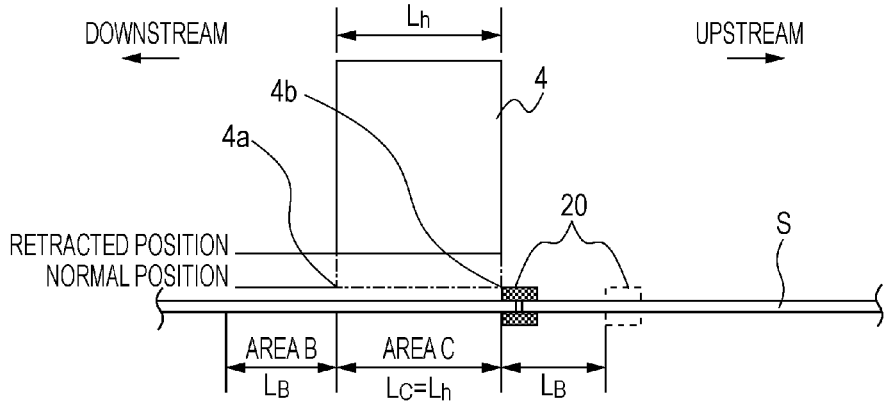
FIGS. 10A and 10B are drawings for explaining a movement of a print head from an area B to an area E.

FIG. 10A is a drawing for explaining the movement of the print head in the area B and the area C. The movement of the print head 14 from the normal position to the retracted position when the splice 20 passes near the print head 14 is conceptually illustrated. The area B is an area where the continuous sheet S is conveyed during a predetermined period when the print head 14 is moved from the normal position to the retracted position. In the area B, the print head 14 is moved upward and hence the distance from the sheet is increased in comparison with the normal state. Therefore, ejection of the ink is not performed. It is because the amount of generated ink mist may increase. A length $L_B$ of the area B in the direction of conveyance is obtained by $L_B = L_{UP}$=speed of conveyance of the sheet $V_m$×time required for moving the print head upward $T_{UP}$. The values $V_m$ and $T_{UP}$ are both constant, the value LB is also a constant predetermined value. The timing of start of the upward movement of the print head 14 is a moment when the trailing end of the area A2 of the continuous sheet S passes through the printing position 4*b* of the upstream-most print head from among the plurality of print heads 14 of the printing unit 4.

The area C has a width $L_C$ which is equivalent to a distance $L_h$ between the printing position 4*a* of the downstream-most print head and the printing position 4*b* of the upstream-most print head from among the plurality of print heads 14 in the direction of conveyance. In other words, a moment when a boundary between the area B and the area C reaches the printing position 4*a* of the downstream-most print head, a boundary between the area C and the splice 20 is positioned at the printing position 4*b* of the upstream-most print head. In the area C, the print head 14 is moved upward and hence the gap from the sheet is increased in comparison with the normal state. Therefore, the ejection of the ink is not performed.

The total length of the area B and the area C in the direction of conveyance corresponds to a length which does not cause the splice 20 to reach under the print head and come into contact therewith before the gap between the print head and the continuous sheet becomes maximum (retracted state). Therefore, the contact of the splice 20 with the print head 14 is reliably avoided.

Figure 10B:
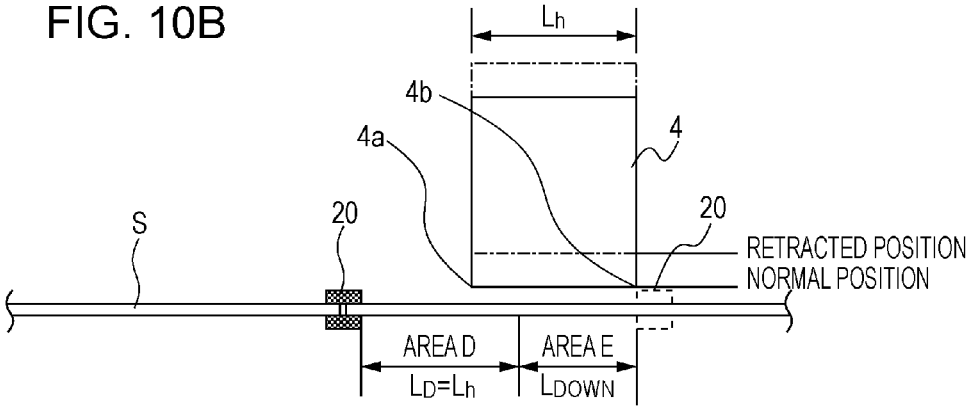

FIG. 10B is a drawing for explaining the movement of the print head in the area D and the area E. The movement of the print head 14 from the retracted position to the normal position when the splice 20 passes under the retracted print head 14 is conceptually illustrated. The area D has a width $L_D$ which is equivalent to the distance $L_h$ between the printing position 4*a* of the downstream-most print head and the printing position 4*b* of the upstream-most print head in the direction of conveyance like the area C. In other words, when a boundary between the splice 20 and the area D reaches the printing position 4*a* of the downstream-most print head, a boundary between the area D and the area E is positioned at the printing position 4*b* of the upstream-most print head. The area D is an area existing immediately under the print head 14 at a timing when the splice 20 has passed immediately under the print head completely, and the print head 14 is moved upward and hence the gap from the sheet is increased. Therefore the ejection of the ink is not performed.

The area E is an area where the continuous sheet S is conveyed during a predetermined period when the print head 14 is moved from the retracted position to the normal position. In the area E, the distance between the print head 14 and the sheet is increased in comparison with the normal state. Therefore, the ejection of the ink is not performed. A length $L_E$ of the area E in the direction of conveyance is obtained by $L_E=L_{down}$=speed of conveyance of the sheet $V_m$×time required for moving the print head downward $T_{down}$. The values $V_m$ and $T_{down}$ are both constant, the value $L_E$ is also a constant value. If the $T_{DOWN}$ and the $T_{UP}$ are the same, the length of the area B and the length of the area E are the same. The timing of start of the downward movement of the print head 14 is a moment when the boundary between the area D and the area E of the continuous sheet S passes through the printing position 4*b* of the upstream-most print head. The total length of the area D and the area E in the direction of conveyance is a length which does not cause printing to be started before the splice 20 leaves a portion under the print head completely and hence does not cause any image failure.

When FIGS. 7A and 7B and FIGS. 10A and 10B are referred to, a sum of the areas ($L_A+L_B+L_C$) on the downstream side of the splice 20 corresponds to $L_o$ (the length of the continuous sheet from the position where the printing by the print head 14 is started to the position where the splice sensor 17 is sensed). It is expressed by (Expression 4) shown below;

$$L_A+L_B+L_C=L_0>(PL_{MAX}+L_{CM})+(V_m\times T_{UP})+L_h \quad \text{(Expression 4).}$$

In other words, the length of the continuous sheet in the conveying path from the detected position to the printing position is larger than a sum of three parameters. The three parameters are the length of the plurality of print heads in the direction of conveyance, the distance of movement of the continuous sheet in the period required for the adjusting mechanism to increase the distance and the length of the unit image having the maximum size. As described above, the skew correcting unit 3 configured to convey the continuous sheet while forming the loop is provided in the conveying path from the sensing position to the printing position. Since a sufficient length of the continuous sheet is secured in this section by the formation of the loop in the midsection thereof, the length of the $L_0$ in the (Expression 4) can be increased irrespective of the compactness of the apparatus, so that the repeated printing of the larger unit images is supported.

According to the embodiment described above, the printing on splices is prevented when printing a plurality of images in sequence on a continuous sheet having a splice and contact of the splice of the continuous sheet with a print head is reliably avoided. Since ink is never ejected in a state in which a gap between the print head and the sheet is larger than in the normal state, positional displacement of ink dots or increase in amount of generated ink mist than in the normal state are both prevented. Since the area where printing is not performed (area A2) is small, the area which wastes the continuous sheet may be small. Since the mixing of sheets having defective images printed thereon into the finally output plurality of cut sheets or the change of the sequence of the images is prevented, the users are not obliged to perform troublesome works.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-111534 filed May 13, 2010, which is hereby incorporated by reference herein in its entirety.

What is claimed is:

1. An apparatus comprising:

a sheet feeding unit configured to feed a continuous sheet along a path;

a printing unit including a plurality of print heads, wherein the printing unit is configured to print, at a printing position, unit images in sequence on the continuous sheet fed from the sheet feeding unit;

a sensing unit configured to sense a splice of the continuous sheet at a sensing position, wherein the sensing position is provided in the path and upstream of the printing position;

an adjusting mechanism configured to change a print gap between a print head and the continuous sheet; and a control unit, configured to control, wherein the control unit controls the adjusting mechanism to temporarily increase the print gap when the splice passes under the print head and to change the print gap while the continuous sheet is moving, wherein, when the sensing unit senses the splice during printing of one unit image at the printing position, the control unit controls the printing unit to continue printing a remainder of the one unit image while setting an unprintable area in a direction of sheet conveyance and avoiding printing in the unprintable area, and wherein the unprintable area includes the splice and is set in a first unprintable area located on a downstream side of the splice and a second unprintable area located on an upstream side of the splice, wherein the first unprintable area and the second unprintable area each have at least a predetermined length corresponding to a sum of (i) a length of the plurality of print heads in the sheet conveyance direction and (ii) a distance of movement of the continuous sheet in a period required by the adjusting mechanism to change the print gap while the continuous sheet is moving.

2. The apparatus according to claim 1, wherein, when the sensing unit senses the splice, the control unit calculates, as a number, a quantity of unit images which can be printed on the continuous sheet residing from the printing position to the unprintable area according to a sensed timing, and wherein the sum of (i) the length of the plurality of print heads in the sheet conveyance direction, (ii) the distance of movement of the continuous sheet in a period required by the adjusting mechanism to perform an increase change in the print gap, and (iii) a length of the one unit image having a maximum size in the sheet conveyance direction is smaller than a length of the continuous sheet in a path from the printing position to the sensing position.

3. The apparatus according to claim 1, further comprising a skew correcting unit configured to correct a skew of the continuous sheet while forming a loop in the path at a position between the printing position and the sensing position.

4. The apparatus according to claim 1, further comprising a cutter unit configured to cut the continuous sheet printed by the printing unit, wherein the cutter unit cuts the continuous sheet to divide the unit images into a plurality of individual unit images.

5. The apparatus according to claim 1, further comprising a reverse unit configured to reverse the continuous sheet during duplex printing, wherein the control unit controls so that, in the duplex printing, the printing unit performs printing of a plurality of the unit images on a first surface of the continuous sheet fed from the sheet feeding unit, the printed sheet is reversed by the reverse unit to feed the reversed sheet to the printing unit, and the printing unit performs printing of a plurality of the unit images on a second surface of the continuous sheet, which is a back of the first surface of the continuous sheet fed from the reverse unit.

6. The apparatus according to claim 1, wherein the unprintable area is an area where a unit image cannot be printed and wherein, when the sensing unit senses the splice during the printing of the one unit image at the printing position, the control unit controls to set the unprintable area and to set a printable area downstream of the unprintable area in the sheet conveyance direction, wherein the printable area is where a unit image can be printed and includes a first printable area where the unit image is to be printed and a second printable area where the unit image is not to be printed.

7. The apparatus according to claim 6, wherein a length of each first printable area in the sheet conveyance direction varies depending on a timing of when a splice is sensed by the sensing unit.

8. The apparatus according to claim 1, wherein, in a case where the sensing unit senses a splice during printing of the one unit image, the control unit controls to set the unprintable area and to set a printable area downstream of the unprintable area in the sheet conveyance direction, wherein the printable area is set to be longer than (i) a remaining amount of the one unit image to be printed plus (ii) a margin within which a cut mark is to be printed, such that the printable area includes a second printable area where the unit image can be printed but is not to be printed and printing of the one unit image being printed when the splice is sensed by the sensing unit can be completed irrespective of a timing when the splice is sensed by the sensing unit.

9. The apparatus according to claim 8, further comprising a cutter unit configured to cut the continuous sheet printed by the printing unit, wherein the second printable area is small, the cutter unit separates the second printable area and the unprintable area from the continuous sheet, and the control unit controls to discharged the second printable area and the unprintable area to a trash box as the defective images, whereby since the second printable area, as an area where printing is not performed, is small, an area which wastes the continuous sheet is maintained as small.

10. The apparatus according to claim 1, wherein, after the unprintable area is set and before the printing unit completes printing the one unit image, the control unit determines whether a second unit image can be printed between the one unit image and the unprintable area.

11. The apparatus according to claim 1, wherein the continuous sheet includes splices that are joined portions joined with a tape or glue at one or more random positions, and wherein the sensing unit is configured to sense a passage of a splice through one of a level difference, a reflectivity difference, a transmissive difference, and direct-contact.

12. The apparatus according to claim 1, wherein the printing apparatus is a high-speed line printer that supports both simplex printing and duplex printing and the continuous sheet passing below the print gap between the print head and the continuous sheet is longer than one print unit repeated in the sheet conveyance direction.

13. A method for an apparatus, the method comprising:

feeding a continuous sheet along a path using a sheet feeding unit;

printing, at a printing position using a printing unit including a plurality of print heads, unit images in sequence on the continuous sheet fed from the sheet feeding unit;

sensing, using a sensing unit, a splice of the continuous sheet at a sensing position, wherein the sensing position is provided in the path and upstream of the printing position;

changing a print gap between a print head and the continuous sheet using an adjusting mechanism; and controlling, using a control unit, the adjusting mechanism to temporarily increase the print gap when the splice passes under the print head and to change the print gap while the continuous sheet is moving, wherein, when the sensing unit senses the splice during printing of one unit image at the printing position, the control unit controls the printing unit to continue printing a remainder of the one unit image while setting an unprintable area in a direction of sheet conveyance and avoiding printing in the unprintable area, and wherein the unprintable area includes the splice and is set in a first unprintable area located on a downstream side of the splice and a second unprintable area located on an upstream side of the splice, wherein the first unprintable area and the second unprintable area each have at least a predetermined length corresponding to a sum of (i) a length of the plurality of print heads in the sheet conveyance direction and (ii) a distance of movement of the continuous sheet in a period required by the adjusting mechanism to change the print gap while the continuous sheet is moving.

* * * * *